US009915907B2

(12) United States Patent
Takatou

(10) Patent No.: US 9,915,907 B2
(45) Date of Patent: Mar. 13, 2018

(54) DOCUMENT CONVEYING APPARATUS, CONTROL METHOD, AND COMPUTER-READABLE, NON-TRANSITORY MEDIUM

(71) Applicant: PFU LIMITED, Kahoku-shi, Ishikawa (JP)

(72) Inventor: Yuki Takatou, Kahoku (JP)

(73) Assignee: PFU LIMITED, Ishikawa (JP)

( * ) Notice: Subject to any disclaimer, the term of this patent is extended or adjusted under 35 U.S.C. 154(b) by 26 days.

(21) Appl. No.: 15/337,205

(22) Filed: Oct. 28, 2016

(65) Prior Publication Data

US 2018/0032018 A1 Feb. 1, 2018

(30) Foreign Application Priority Data

Jul. 29, 2016 (JP) ..... 2016-150319

(51) Int. Cl.
*B65H 3/06* (2006.01)
*G03G 15/00* (2006.01)

(52) U.S. Cl.
CPC ..... *G03G 15/70* (2013.01); *B65H 3/063* (2013.01)

(58) Field of Classification Search
CPC ..... B65H 3/063; B65H 3/0653; B65H 3/08; G03G 15/70
See application file for complete search history.

(56) References Cited

U.S. PATENT DOCUMENTS 6,508,465 B1 * 1/2003 Endo ..... B65H 3/06 271/265.01
2004/0188916 A1 * 9/2004 Tsukamoto ..... B65H 3/06 271/110
2007/0080492 A1 * 4/2007 Suzuki ..... B65H 3/063 271/117

(Continued)

FOREIGN PATENT DOCUMENTS

JP 4-266340 A 9/1992
JP 2005-170651 A 6/2005

OTHER PUBLICATIONS

Office Action for the corresponding Japanese Patent Application No. 2016-150319, dated Aug. 1, 2017, 2 pages (with English translation, 3 pages).

*Primary Examiner* — David Banh
(74) *Attorney, Agent, or Firm* — Lewis Roca Rothgerber Christie LLP

(57) ABSTRACT

The document conveying apparatus includes a document tray, a butted part with which leading edges of a plurality of documents stacked on the document tray are butted, a roller for conveying a document stacked at a lowermost position, a pressurizing module for pressurizing, from above, the documents stacked on the document tray, a separator, a first detector, provided between the butted part and the separator in a document conveying direction, for detecting a conveyed document, and a control module for causing the pressurizing module to pressurize the documents stacked on the document tray and causing the roller to rotate with a first speed until the first detector detects a document. In a case where the first detector detects a document, the control module reduces a force with which the pressurizing module pressurizes the documents and causes the roller to rotate with a second speed slower than the first speed.

6 Claims, 10 Drawing Sheets

(56) References Cited

U.S. PATENT DOCUMENTS

| | | | | |
|---|---|---|---|---|
| 2007/0108696 | A1* | 5/2007 | Yorimoto | B65H 3/06 271/121 |
| 2007/0126171 | A1* | 6/2007 | Takeuchi | B65H 3/5261 271/121 |
| 2012/0113488 | A1* | 5/2012 | Machida | B65H 3/063 358/498 |
| 2012/0146282 | A1* | 6/2012 | Chiba | B65H 1/14 271/160 |
| 2014/0062008 | A1* | 3/2014 | Hongo | B65H 7/02 271/258.01 |
| 2014/0084535 | A1* | 3/2014 | Taylor, III | B65H 7/20 271/111 |
| 2015/0001786 | A1* | 1/2015 | Kosuga | B65H 1/14 271/110 |
| 2015/0061211 | A1* | 3/2015 | Hou | B65H 3/063 271/18 |
| 2015/0091243 | A1* | 4/2015 | Kobayashi | B65H 3/0684 271/110 |
| 2015/0274452 | A1* | 10/2015 | Tanaka | B65H 3/06 271/10.16 |

* cited by examiner

DOCUMENT CONVEYING APPARATUS, CONTROL METHOD, AND COMPUTER-READABLE, NON-TRANSITORY MEDIUM

CROSS-REFERENCE TO RELATED APPLICATIONS

This application is based upon and claims the benefit of priority of prior Japanese Patent Application No. 2016-150319, filed on Jul. 29, 2016, the entire contents of which are incorporated herein by reference.

TECHNICAL FIELD

Embodiments discussed in the present specification relate to document conveying technology.

BACKGROUND

A document conveying apparatuses such as a scanner are used for various purposes in various locations such as households and offices, and various types of document conveying apparatuses have been provided in accordance with the purposes. For example, in offices and the like, in order to allow more documents to be conveyed at a time, a so-called document conveying apparatus of a lower side retrieval method is used. In the document conveying apparatus of the lower side retrieval method, a document stacking angle of a document tray for stacking documents is almost horizontal, and documents stacked at a lower position are conveyed in order by a pick roller provided in the document tray.

In order to allow the documents stacked on the document tray to be conveyed in a preferable manner by the pick roller, the document conveying apparatus of the lower side retrieval method is provided with a pick arm for pressing, from above, documents stacked on the document tray. However, when the pressurizing force for pressurizing the documents with the pick arm is too small, the pick roller cannot convey the documents, and thus, when the pressurizing force is too large, the frictional force between the stacked documents increases, which may cause a multi-feed of documents.

A sheet-shaped body conveying apparatus including a separate roller, a separation pad disposed to face the separate roller, a retainer spring pressuring the separation pad, and pressurizing force giving means for further increasing the pressurizing force of the retainer spring is disclosed (see Japanese Laid-open Patent Publication No. H4-266340). In this sheet-shaped body conveying apparatus, as soon as a sheet-shaped body stacked on a stacking base is detected to have passed the position of a sensor disposed at a position in proximity to the upstream side of the separate roller, the pressurizing force giving means pressurizing the retainer spring. The pressurizing operation of the pressurizing force giving means is cancelled as soon as the leading edge of the sheet-shaped body is detected to have passed the position of the sensor disposed at the position in proximity to the upstream side of the reading optical system. Therefore, in the sheet-shaped body conveying apparatus, the pressurizing force giving means is activated to strongly pressurize the separation pad onto the separate roller only when an operation for separating the sheet-shaped body is performed.

A feeding apparatus of a lower side retrieval type having a first pick roller provided with a pick roller having an adjustable applied pressure is disclosed (see Japanese Laid-open Patent Publication No. 2005-170651). A default applied pressure value is set for this pick roller, and the pick roller presses a sheet onto the first pick roller with the default applied pressure value when sheet feeding is started. This feeding apparatus uses a sheet conveying sensor disposed on a sheet conveying path to detect whether a sheet is conveyed or not, and in a case where a picking of a sheet with the first pick roller fails, the applied pressure with the pick roller is controlled to be increased by a predetermined amount.

SUMMARY

In the document conveying apparatus of the lower side retrieval method, it is desired to execute conveying processing of documents at a high speed while preventing multi-feed of documents.

It is an object to provide a document conveying apparatus and a control method that can execute conveying processing of documents at a high speed while preventing multi-feed of documents with the document conveying apparatus of lower side retrieval method, and a computer-readable, non-transitory medium storing a computer program for causing a document conveying apparatus to implement such a control method.

According to an aspect of the apparatus, there is provided a document conveying apparatus. The document conveying apparatus includes a document tray, a butted part with which leading edges of a plurality of documents stacked on the document tray are butted, a roller for conveying a document stacked at a lowermost position, which is one of the documents stacked on the document tray, a pressurizing module, provided at a position facing the roller, for pressurizing, from above, the documents stacked on the document tray, a separator for separating and conveying the documents, a first detector, provided between the butted part and the separator in a document conveying direction, for detecting a conveyed document, and a control module for causing the pressurizing module to pressurize the documents stacked on the document tray and causing the roller to rotate with a first speed until the first detector detects a document. In a case where the first detector detects a document, the control module reduces a force with which the pressurizing module pressurizes the documents and causes the roller to rotate with a second speed slower than the first speed.

According to an aspect of the method, there is provide a control method for a document conveying apparatus including a document tray, a butted part with which leading edges of a plurality of documents stacked on the document tray are butted, a roller for conveying a document stacked at a lowermost position, which is one of the documents stacked on the document tray, a pressurizing module, provided at a position facing the roller, for pressurizing, from above, the documents stacked on the document tray, and a separator for separating and conveying the documents. The control method includes causing the pressurizing module to pressurize the documents stacked on the document tray and causing the roller to rotate with a first speed until a first detector, provided between the butted part and the separator in a document conveying direction, for detecting a conveyed document, detects the document, and in a case where the first detector detects a document, reducing a force with which the pressurizing module pressurizes the documents and causing the roller to rotate with a second speed slower than the first speed.

According to an aspect of the computer-readable, non-transitory medium storing a computer program, the computer program causes a document conveying apparatus including a document tray, a butted part with which leading edges of a plurality of documents stacked on the document tray are butted, a roller for conveying a document stacked at a lowermost position, which is one of the documents stacked on the document tray, a pressurizing module, provided at a position facing the roller, for pressurizing, from above, the documents stacked on the document tray, and a separator for separating and conveying the documents, to execute a process, including causing the pressurizing module to pressurize the documents stacked on the document tray and causing the roller to rotate with a first speed until a first detector provided between the butted part and the separator in a document conveying direction to detect a document conveyed detects the document, and when the first detector detects a document, reducing a force with which the pressurizing module pressurizes the documents and causing the roller to rotate with a second speed slower than the first speed.

The object and advantages of the invention will be realized and attained by means of the elements and combinations particularly pointed out in the claims. It is to be understood that both the foregoing general description and the following detailed description are exemplary and explanatory and are not restrictive of the invention, as claimed.

DESCRIPTION OF EMBODIMENTS

Hereinafter, a document conveying apparatus, a control method, and computer program according to an embodiment, will be described with reference to the drawings. However, note that the technical scope of the invention is not limited to these embodiments and extends to the inventions described in the claims and their equivalents.

Figure 1:
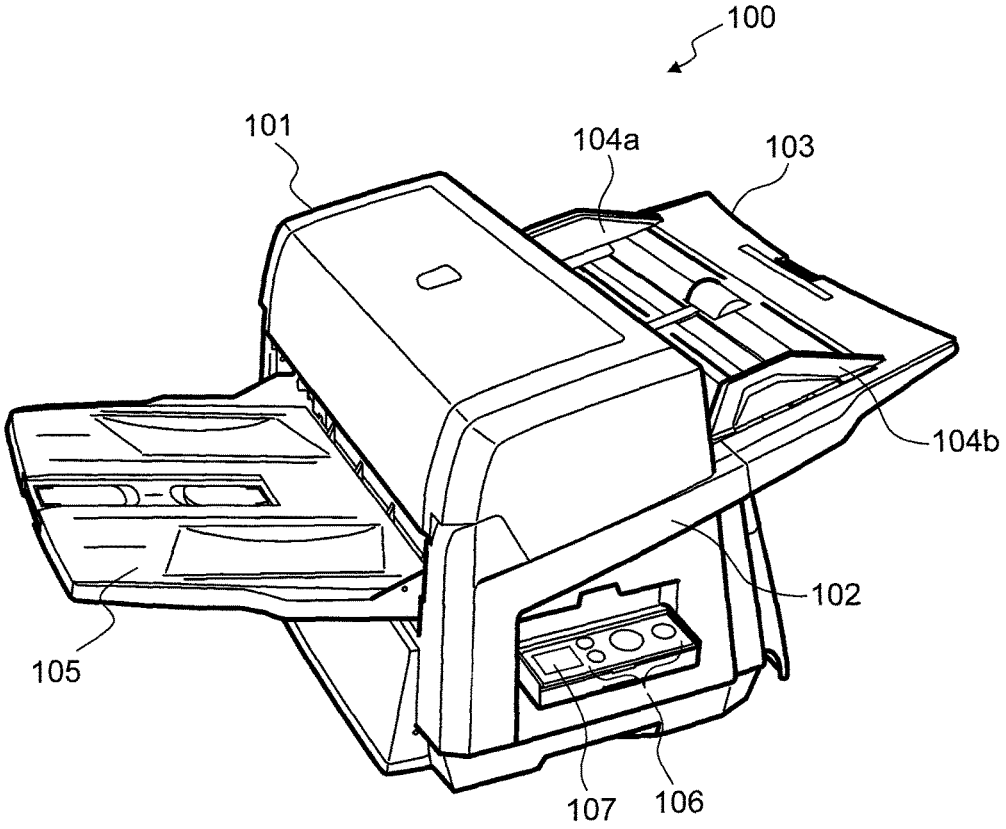
FIG. 1 is a perspective view illustrating a document conveying apparatus 100.

FIG. 1 is perspective view illustrating a document conveying apparatus 100 configured as an image scanner according to an embodiment.

The document conveying apparatus 100 includes an upper side housing 101, a lower side housing 102, a document tray 103, a discharged sheet stacker 105, multiple operation buttons 106, a display device 107, etc.

The upper side housing 101 is arranged at a position to cover the upper surface of the document conveying apparatus 100, and is attached to the lower side housing 102 with a hinge so as to be able to open and close, at the time of a paper jam, at the time of cleaning of the document conveying apparatus 100, etc.

The document tray 103 is engaged with the lower side housing 102 in such a manner that the document can be placed on the document tray 103. The document tray 103 is provided with side guides 104*a* and 104*b* which can move in a direction perpendicular to the conveying direction of the document. Hereinafter, the side guides 104*a* and 104*b* may be collectively referred to as side guides 104.

The discharged sheet stacker 105 is attached to the lower side housing 102 in such a manner that the discharged sheet stacker 105 can hold the discharged documents.

The operation buttons 106 is arranged a side portion of the lower side housing 102, and when the operation button 106 is pressed down, the operation button 106 generates and outputs an operation detection signal in accordance with the button.

The display device 107 includes a display constituted by a liquid crystal, an organic EL (Electro-Luminescence), etc., and an interface circuit for outputting image data to the display, and displays the image data to the display.

Figure 2:
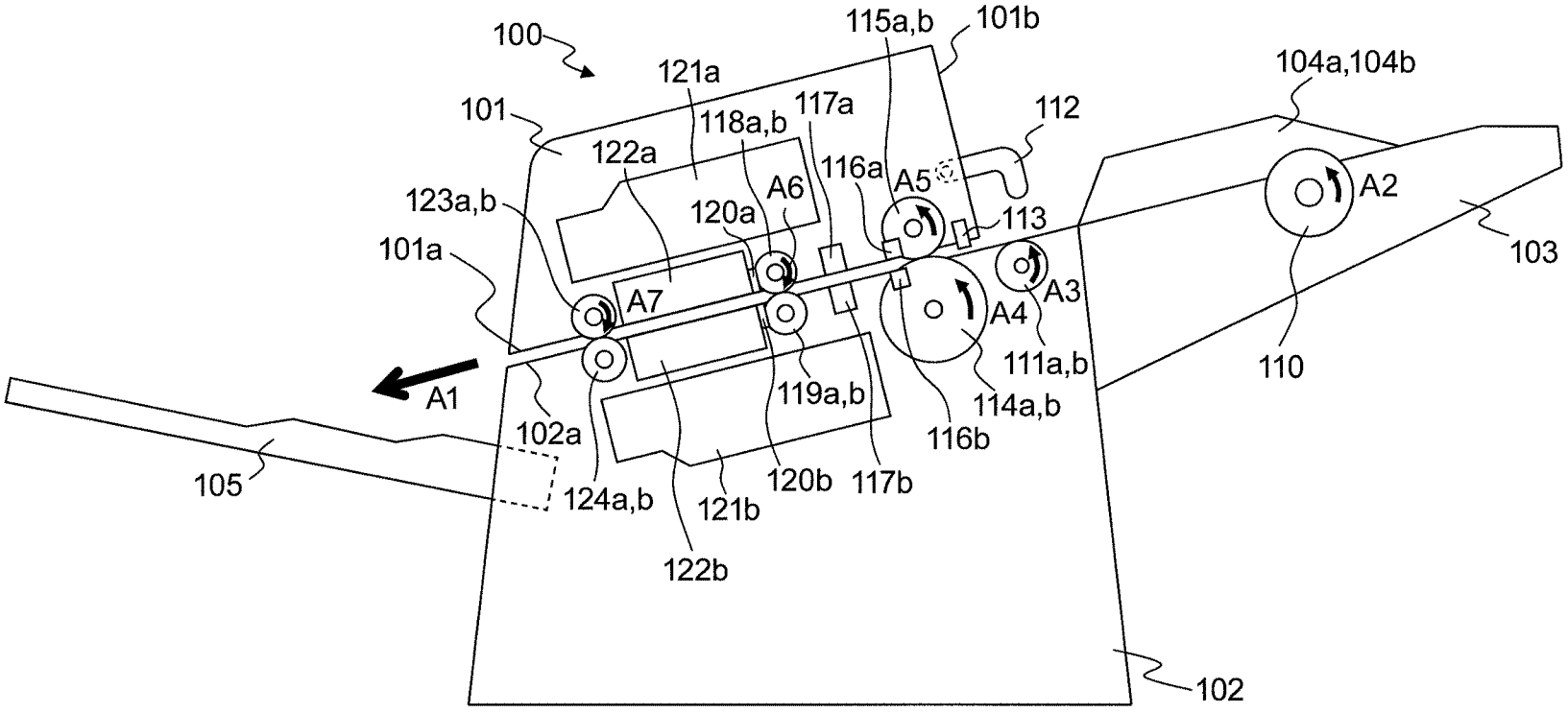
FIG. 2 is a figure for explaining a conveying path in the document conveying apparatus 100.

FIG. 2 is a figure for explaining a conveying path inside of the document conveying apparatus 100.

The conveying path inside of the document conveying apparatus 100 includes a shoot roller 110, a pick roller 111*a*, 111*b*, a pick arm 112, a contact sensor 113, feeding rollers 114*a*, 115*b*, retard rollers 115*a*, 115*b*, a first light emitter 116*a*, a first light receiver 116*b*, an ultrasonic transmitter 117*a*, an ultrasonic receiver 117*b*, first conveying rollers 118*a*, 118*b*, first driven rollers 119*a*, 119*b*, a second light emitter 120*a*, a second light receiver 120*b*, a first image capturing device 121*a*, a second image capturing device 121*b*, a first illumination device 122*a*, a second illumination device 122*b*, second conveying rollers 123*a*, 123*b*, second driven rollers 124*a*, 124*b*, etc.

In the following explanation, the pick roller 111*a* and 111*b* may be collectively referred to as the pick roller 111. The feeding rollers 114*a* and 114*b* may be collectively referred to as the feeding roller 114. The retard rollers 115*a* and 115*b* may be collectively referred to as the brake roller 115. The first conveying rollers 118*a* and 118*b* may be collectively referred to as the first conveying roller 118. The first driven rollers 119*a* and 119*b* may be collectively referred to as the first driven roller 119. The second conveying rollers 123*a* and 123*b* may be collectively referred to as the second conveying roller 123. The second driven rollers 124*a* and 124*b* may be collectively referred to as the second driven roller 124.

The lower surface of the upper side housing 101 forms a upper side guide 108*a* of the conveying route for the documents, and the upper surface of the lower side housing 102 forms an lower side guide 108*b* of the conveying route for the documents. A side surface of the upper side housing 101 at the side of the document tray 103 forms a butted part 101*b* with which the leading edges of multiple documents stacked on the document tray 103 are butted. In FIG. 2, arrow A1 indicates the conveying direction of the documents. In the following explanation, the upstream means the upstream in the conveying direction A1 of the documents, and the downstream means the downstream in the conveying direction A1 of the documents.

The shoot roller 110 is provided in the document tray 103, and is configured to be in contact with one of documents stacked on the document tray 103 and located at the lowermost position, so that the shoot roller 110 feeds the documents in the document conveying direction A1.

The pick roller 111 is an example of a roller, and is provided in the lower side housing 102, and is configured to be in contact with one of documents stacked on the document tray 103 in such a manner that the leading edges thereof is butted against a butted part 101*b* of the upper side housing 101 and located at the lowermost position, and feeds the documents in the document conveying direction A1. With the actions performed by the shoot roller 110 and the pick roller 111, the document conveying apparatus 100 conveys the documents in accordance with so-called lower side retrieval method.

The pick arm 112 is an example of a pressurizing module, and is provided on the upper side housing 101 in such a manner that the pick arm 112 is at a position facing the pick roller 111. The pick arm 112 pressurizes, from above, documents placed on the document tray 103 in such a manner that an appropriate frictional force is generated between the pick roller 111 and the documents placed on the document tray 103 to enable the pick roller 111 to convey the documents in a preferable manner.

The contact sensor 113 is provided at the upstream side with respect to the feeding roller 114 and the retard roller 115, and detects whether or not a document is placed on the document tray 103. The contact sensor 113 generates and outputs a first document detection signal of which signal value changes depending on a state in which the document is placed on the document tray 103 and a state in which the document is not placed on the document tray 103.

The contact sensor 113 is an example of a first detector, and is provided between the butted part 101*b* and separator (the feeding roller 114 and the retard roller 115). The contact sensor 113 is configured to detect a document conveyed. The contact sensor 113 generates and outputs a first document detection signal which yields a signal value that changes between a state in which a document exists between the butted part 101*b* and the separator and a state in which no document exists.

The feeding roller 114 is provided in the lower side housing 102, and feeds the documents stacked on the document tray 103 toward a document conveying direction A1. The retard roller 115 is provided in the upper side housing 101 in such a manner that the retard roller 115 is disposed at a position facing the feeding roller 114, and performs separation operation of documents. The feeding roller 114 and the retard roller 115 are examples of a separator, and separates and conveys documents.

The first light emitter 116*a* and the first light receiver 116*b* are an example of a second detector, and are provided at the downstream side with respect to the feeding roller 114 and the retard roller 115 and at the upstream side with respect to the first conveying roller 118 and the first driven roller 119, and are arranged to face each other with the conveying route for the documents interposed therebetween. The first light emitter 116*a* emits light to the first light receiver 116*b*. The first light receiver 116*b* detects light emitted from the first light emitter 116*a*, and generates and outputs a second document detection signal which is an electric signal according to the detected light. More specifically, the second document detection signal is a signal of which the value changes depending on a state in which a document exists between the first light emitter 116*a* and the first light receiver 116*b* and a state in which a document does not exist between the first light emitter 116*a* and the first light receiver 116*b*. Hereinafter, the first light emitter 116*a* and the first light receiver 116*b* may be collectively referred to as the first light sensor 116.

The ultrasonic transmitter 117*a* and the ultrasonic receiver 117*b* are arranged in proximity to the conveying route for the documents so as to face each other with the conveying route interposed therebetween. The ultrasonic transmitter 117*a* transmits an ultrasonic wave. On the other hand, the ultrasonic receiver 117*b* detects the ultrasonic wave that has been transmitted by the ultrasonic transmitter 117*a* and that has passed through a document, and generates and outputs an ultrasonic signal which is an electric signal according to the detected ultrasonic wave. In the following explanation, the ultrasonic transmitter 117*a* and the ultrasonic receiver 117*b* may be collectively referred to as the ultrasonic sensor 117.

The second light emitter 120*a* and the second light receiver 120*b* are disposed at a downstream side with respect to the first conveying roller 118 and the first driven roller 119 and at an upstream side with respect to the first illumination device 122*a* and the second illumination device 122*b* (i.e., the imaging positions of the first image capturing device 121*a* and the second image capturing device 121*b*) in such a manner that the second light emitter 120*a* and the second light receiver device 120*b* are disposed to face each other with a conveying path of a document interposed therebetween. The second light emitter 120*a* emits light to the second light receiver 120*b*. The second light receiver 120*b* detects light emitted from the second light emitter 120*a*, and generates and outputs a third document detection signal which is an electric signal according to the detected light. More specifically, the third document detection signal is a signal of which the value changes depending on a state in which a document exists between the second light emitter 120*a* and the second light receiver 120*b* and a state in which a document does not exist between the second light emitter 120*a* and the second light receiver 120*b*. Hereinafter, the second light emitter 120*a* and the second light receiver 120*b* may be collectively referred to as the second light sensor 120.

The first image capturing device 121*a* includes an image capturing sensor of a reduced optical system type having an image capturing device based on CCD (Charge Coupled Device) arranged in a linear manner in a main scanning direction. This image capturing sensor reads the back surface of the document, and generates and outputs an analog image signal. Likewise, the second image capturing device 121*b* includes an image capturing sensor of a reduced optical system type based on CCD arranged in the linear manner in the main scanning direction. This image capturing sensor generates and outputs an analog image signal by reading the front surface of the document. It should be noted that only one of the first image capturing device 121*a* and the second image capturing device 121*b* may be provided to read only one of the surfaces of a document. Alternatively, it may possible to use a CIS (Contact Image Sensor) of the same-size optical system type having an image capturing device based on CMOS (Complementary Metal Oxide Semiconductor) instead of the CCD. Hereinafter, the first image capturing device 121*a* and the second image capturing device 121*b* may be collectively referred to as the image capturing device 121.

The first illumination device 122*a* includes a light source for illuminating the back surface of a document and a backing that is used for the front surface of the document, and is arranged at a position between the first image capturing device 121*a* and the document conveying route so that the first illumination device 122*a* faces the second image capturing device 121*b*. Likewise, the second illumination device 122*b* includes a light source for illuminating the front surface of a document and a backing that is used for the back surface of the document, and is arranged at a position between the second image capturing device 121*b* and the document conveying route so that the second illumination device 122*b* faces the first image capturing device 121*a*. Hereinafter, the first illumination device 122*a* and the second illumination device 122*b* may be collectively referred to as the illumination device 122.

When the shoot roller 110, the pick roller 111, and the feeding roller 114 rotate, respectively, in the directions of the arrows A2, A3, A4 in FIG. 2, the documents placed on the document tray 103 is conveyed between the upper side guide 101*a* and the lower side guide 102*a* toward the document conveying direction A1. On the other hand, when multiple documents are stacked on the document tray 103, the retard roller 115 rotates in the direction of the arrow A5, so that only the document in contact with the feeding roller 114 is separated from the documents stacked on the document tray 103.

While the document is guided by the upper side guide 101*a* and the lower side guide 102*a*, the document is fed between the first conveying roller 118 and the first driven roller 119. When the first conveying roller 118 rotates in the direction of the arrow A6, the document is fed between the first illumination device 122*a* and the second illumination device 122*b* (i.e., between the first image capturing device 121*a* and the second image capturing device 121*b*). The document read by the image capturing device 121 is discharged onto the discharged sheet stacker 105 when the second conveying roller 123 rotates in the direction of the arrow A7.

Figure 3:
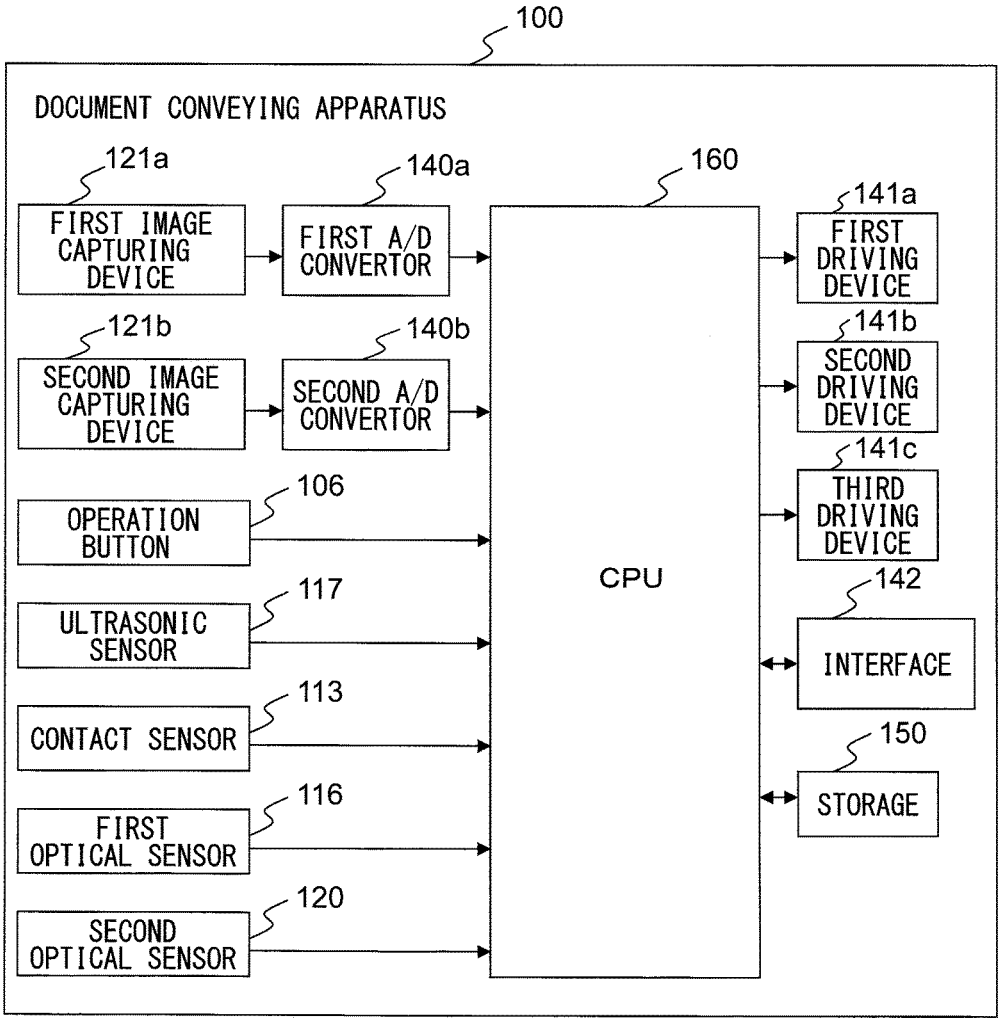
FIG. 3 is a block diagram illustrating a schematic configuration of the document conveying apparatus 100.

FIG. 3 is a block diagram illustrating a schematic configuration of the document conveying apparatus 100.

The document conveying apparatus 100 includes not only the configuration described above but also a first A/D convertor 140*a*, a second A/D convertor 140*b*, a first driving device 141*a*, a second driving device 141*b*, a third driving device 141*c*, an interface 142, a storage 150, a CPU (Central Processing Unit) 160, etc.

The first A/D converter 140*a* performs analog digital conversion to convert an analog image signal which is output from the first image capturing device 121*a*, and generate digital image data, and outputs the digital image data to the CPU 160. Likewise, the second A/D converter 140*b* performs analog digital conversion to convert an analog image signal which is output from the second image capturing device 121*b*, and generate digital image data, and outputs the digital image data to the CPU 160. These digital image data are used as read image. Hereinafter, the first A/D converter 140*a* and the second A/D converter 140*b* may be collectively referred to as the A/D converter 140.

The first driving device 141*a* includes one or more motors, and performs conveying operation of a document s by rotating the shoot roller 110, the pick roller 111, and the feeding roller 114 in accordance with a control signal from the CPU 160. The first driving device 141*a* can change the rotation speed of each roller in accordance with a control signal from the CPU 160. The second driving device 141*b* includes one or more motors, and performs conveying operation of a document by rotating the retard roller 115, the first conveying roller 118, and the second conveying roller 123 in accordance with a control signal from the CPU 160. The third driving device 141*c* moves the pick arm 112 between a facing position at which the pick arm 112 faces the pick roller 111 and a non-facing position at which the pick arm 112 is away from the facing position to the upper side in accordance with a control signal from the CPU 160. In the following explanation, the first driving device 141*a*, the second driving device 141*b*, and the third driving device 141*c* may be collectively referred to as the driving device 141.

The interface 142 includes, for example, an interface circuit based on a serial bus such as USB, and electrically connects with an information processing apparatus, not shown (for example, a personal computer, a portable information terminal, etc.), and transmits and receives read images and various kinds of information. Instead of the interface 142, an antenna for transmitting and receiving a wireless signal and a communication module having a wireless communication interface circuit for transmitting and receiving a signal via a wireless communication circuit in accordance with a predetermined communication protocol may be used. The predetermined communication protocol may be, for example, a wireless LAN (Local Area Network).

The storage 150 includes memory devices such as a RAM (Random Access Memory), a ROM (Read Only Memory), etc., a fixed disk device such as a hard disk, or a portable storage device such as a flexible disk, an optical disk, etc. The storage 150 stores computer programs, databases, tables, etc., used for various kinds of processing of the document conveying apparatus 100. The computer program may be installed on the storage 150 from a computer-readable, non-transitory medium such as a compact disk read only memory (CD-ROM), a digital versatile disk read only memory (DVD-ROM), etc., by using a well-known setup program, etc. Further, the storage 150 stores the read images.

The CPU 160 operates based on a program stored in the storage 150 in advance. Alternatively, a DSP (digital signal processor), an LSI (large scale integration), etc., may be used instead of the CPU 150. As another alternative, an ASIC (Application Specific Integrated Circuit), an FPGA (Field-Programming Gate Array), etc., may be used instead of the CPU 150.

The CPU 160 is connected to the operation button 106, the contact sensor 111, the first light sensor 116, the ultrasonic sensor 117, the second light sensor 120, the image capturing device 121, the A/D converter 140, the driving device 141, the interface 142, the storage 150, etc., and controls each of these modules. The CPU 160 performs document reading control of the image capturing device 121, etc., and obtains read images.

Figure 4:
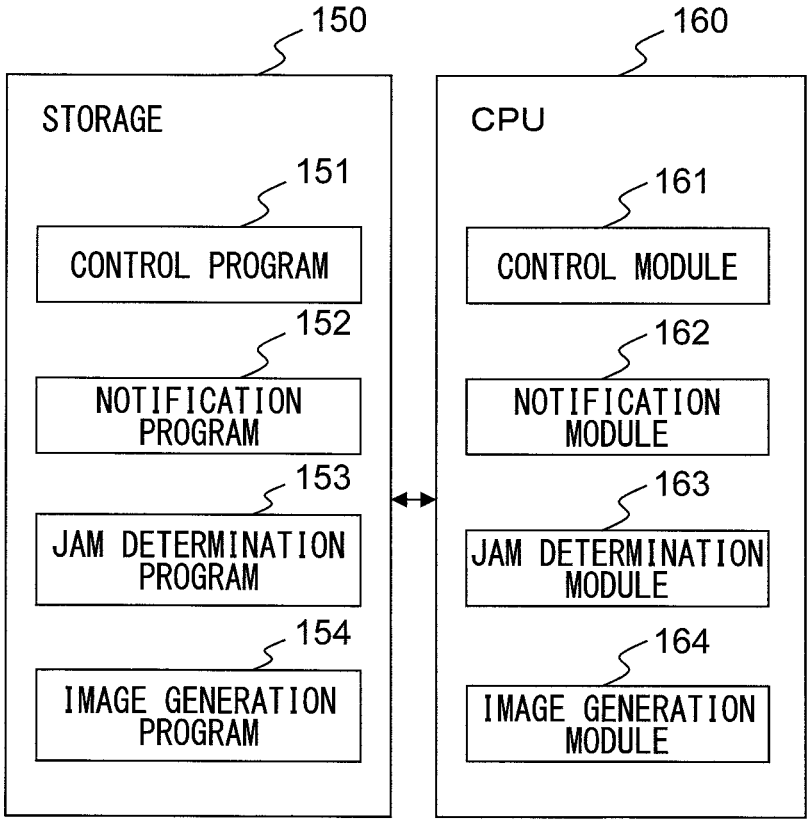
FIG. 4 is a figure illustrating a schematic configuration of a storage 150 and a CPU 160.

FIG. 4 is a figure illustrating a schematic configuration of a storage 150 and a CPU 160.

As illustrated in FIG. 4, the storage 150 stores programs such as a control program 151, a notification program 152, a jam determination program 153, an image generation program 154, and the like. These programs are functional modules implemented by software operating on a processor. The CPU 160 reads the programs stored in the storage 150, and operates in accordance with the read programs, so that the CPU 160 functions as a control module 161, a notification module 162, a jam determination module 163, and an image generation module 164.

Figure 5:
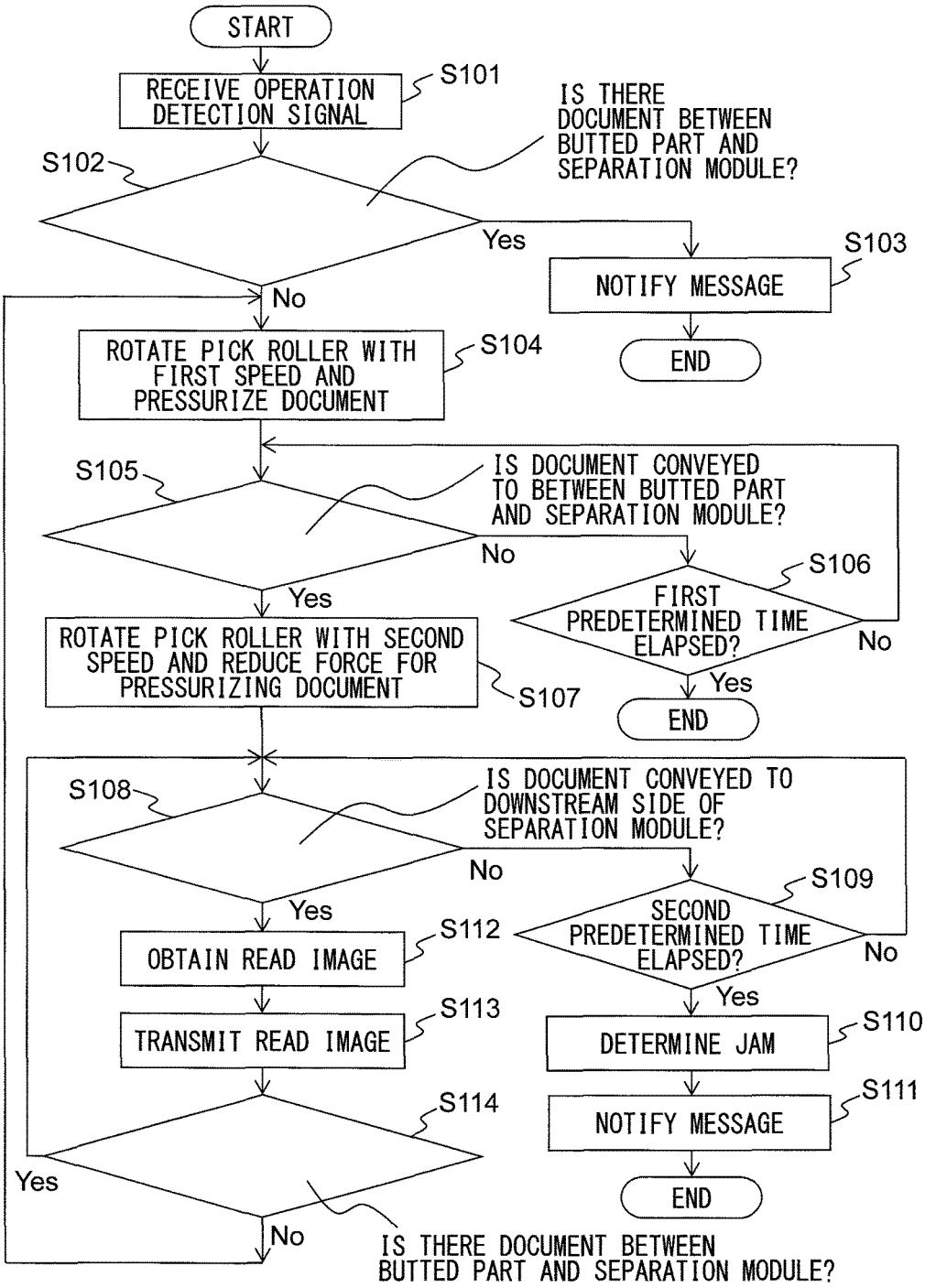
FIG. 5 is a flowchart illustrating an example of an operation of document reading processing.

FIG. 5 is a flow chart illustrating an example of an operation of document reading processing of the document conveying apparatus 100.

Hereinafter, an example of an operation of the entire processing of the document conveying apparatus 100 will be explained with reference to the flow chart as depicted in FIG. 5. It should be noted that the flow of the operation explained below is executed mainly by the CPU 160 in cooperation with each element of the document conveying apparatus 100 based on a program stored in the storage 150 in advance.

At first, the control module 161 waits until the control module 161 receives, from the operation button 106, an operation detection signal for commanding reading a document when a user presses down the operation button 106 for commanding reading of the document (step S101).

Figure 6A:
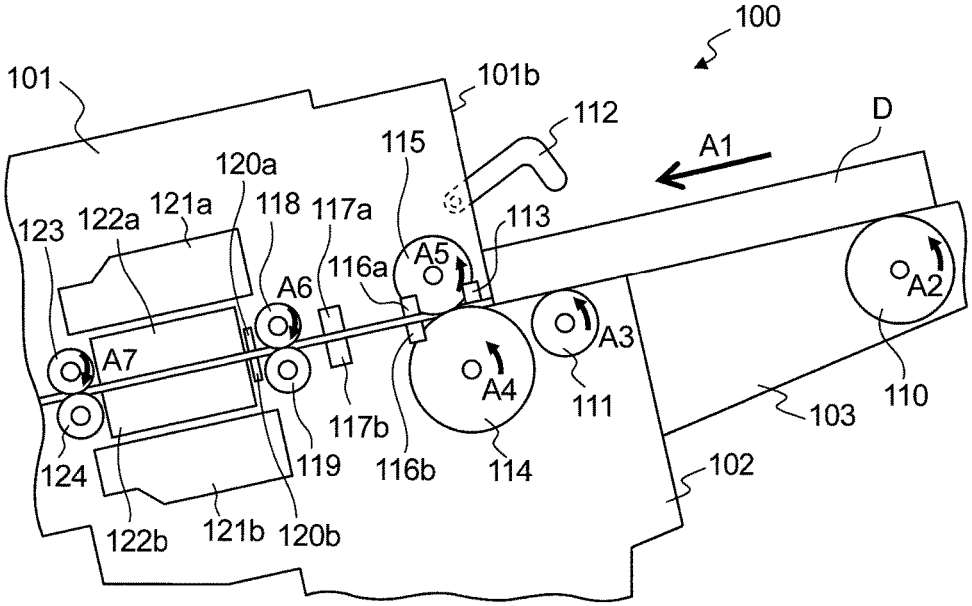
FIG. 6A is a figure illustrating the document conveying apparatus 100 before documents start to be conveyed.

FIG. 6A is a figure illustrating the document conveying apparatus 100 before the documents start to be conveyed.

As illustrated in FIG. 6A, before documents start to be conveyed, the user stacks a document D on the document tray 103, and presses down the operation button 106 to command reading of the document. At this occasion, the pick arm 112 is disposed in a non-facing position, and is not in contact with the document D, so that the user can appropriately place the document D on the document tray 103. In this state, the frictional force between the pick roller 111 and the document D is small, and even when the pick roller 111 rotates, the document D is not conveyed in a preferable manner.

Subsequently, the control module 161 determines whether a document is present at the position of the contact sensor 113, i.e., between the butted part 101*b* and the separator (the feeding roller 114 and the retard roller 115) based on the first document detection signal received from the contact sensor 113 (step S102).

When a document is present between the butted part 101*b* and the separator, the notification module 162 notifies a message for prompting re-stacking the documents (step S103), and terminates the series of steps. The notification module 162 causes the display device 107 to display the message for prompting re-stacking the documents so as to notify the user. Alternatively, the notification module 162 may transmit the message for prompting re-stacking the documents to an information processing apparatus, not shown, via the interface 142. As described above, when the contact sensor 113 detects a document while the pick roller 111 is not rotated, the notification module 162 notifies the message for prompting re-stacking the documents.

FIG. 7A, FIG. 7B, FIG. 8A, FIG. 8B are figures illustrating multiple documents stacked on the document tray 103.

Figure 7A:
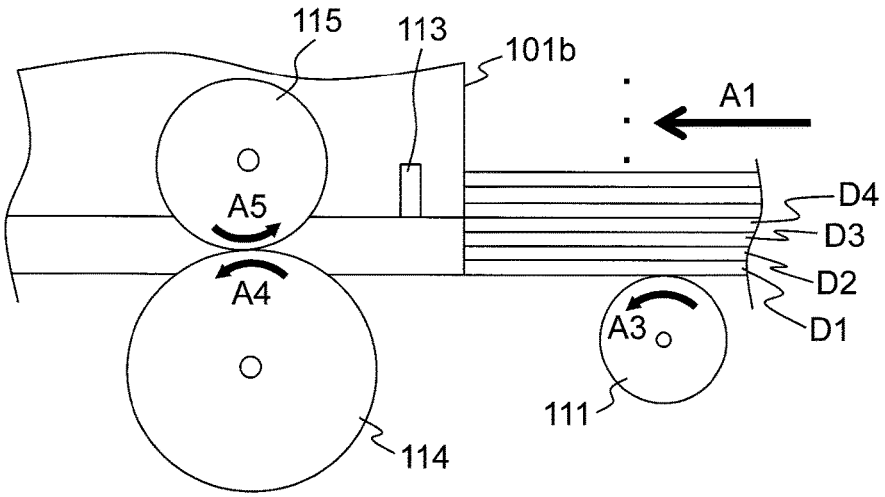
FIG. 7A is a figure illustrating multiple documents stacked on a document tray 103.

When multiple documents are stacked on the document tray 103, the documents may be stacked in various states by the user. FIG. 7A illustrates a case in which the leading edges of the documents are aligned and butted against the butted part 101*b*, and in which no document is disposed at the downstream side with respect to the butted part 101*b*. When the pick roller 111 is rotated in the direction of the arrow A3 to convey the document from this state, only the document D1 at the lowermost position is conveyed toward the downstream with a frictional force between the pick roller 111 and the document D1 stacked at the lowermost position. On the other hand, forces are applied to the documents D2 to D4 stacked at the upper side of the document D1 at the lowermost position in such a manner that a stronger force is applied to documents at a lower position due to the effect of the frictional force between the documents produced by the weights of the documents.

Figure 7B:
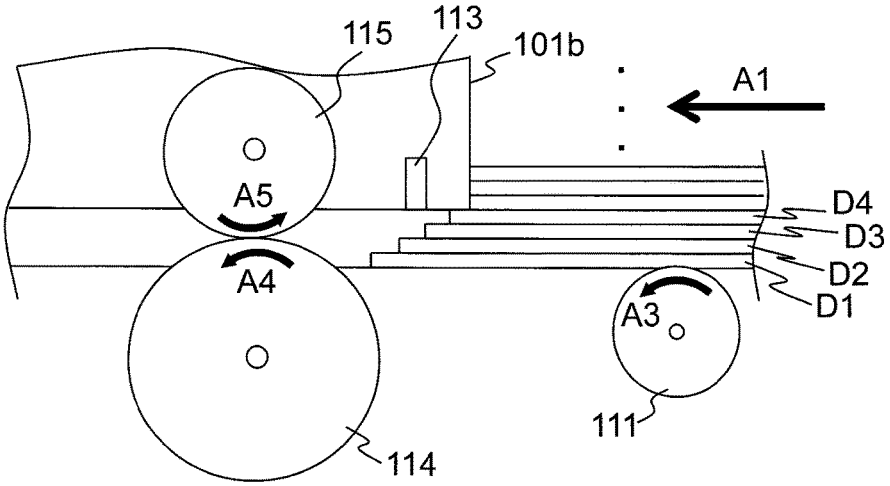
FIG. 7B is a figure illustrating multiple documents stacked on the document tray 103.

Accordingly, as illustrated in FIG. 7B, the documents D1 to D4 are placed in such a state that the leading edges of the documents stacked at a lower position are advanced to the downstream side (so-called taper state). For the documents stacked in the taper state in this manner, the retard roller rotates in the direction of the arrow A5, so that the documents other than the document D1 in contact with the feeding roller 114 are pushed back to the upstream side, so that multi-feed is prevented.

Figure 8A:
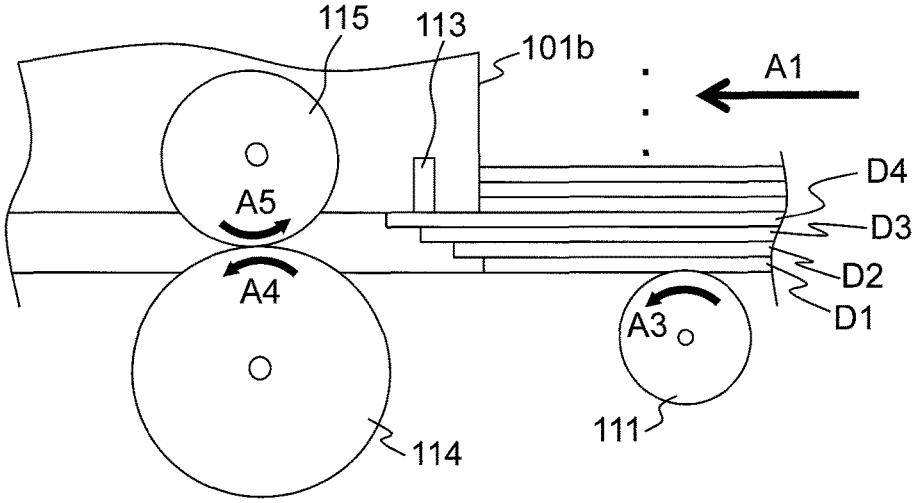
FIG. 8A is a figure illustrating multiple documents stacked on the document tray 103.
Figure 8B:
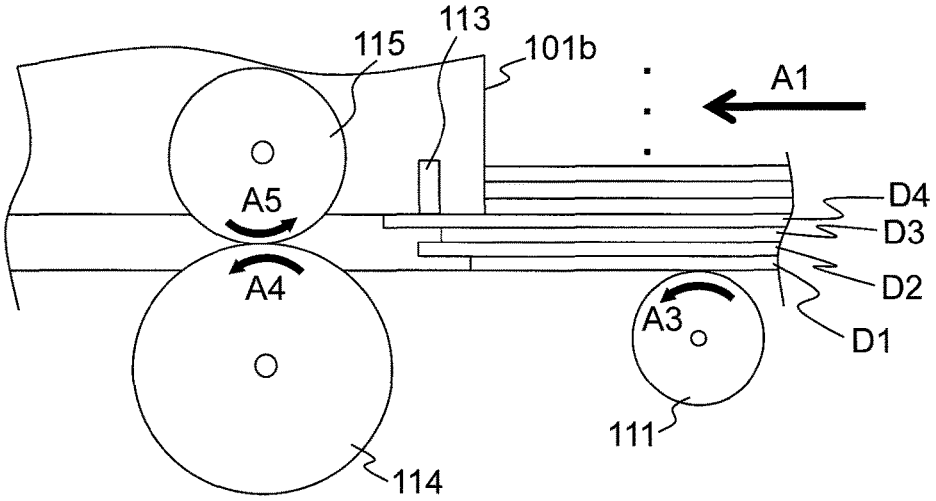
FIG. 8B is a figure illustrating multiple documents stacked on the document tray 103.

On the other hand, FIG. 8A and FIG. 8B illustrate a state in which the leading edges of some of the documents are stacked by the user at the downstream side with respect to the butted part 101*b*. In such case, the leading edges of the documents D1 to D4 disposed at the downstream side with respect to the butted part 101*b* are likely not to be aligned. FIG. 8A illustrates a state in which documents stacked at a higher position are placed in such a manner that their leading edges are located at the downstream side (so-called reverse taper state), and FIG. 8B illustrates a state in which the leading edges of the documents are arranged in an irregular manner (so-called leading edge irregular state).

When multiple documents are conveyed while they are stacked in the reverse taper state or the leading edge irregular state, the documents D2 to D4 stacked at the upper side of the document D1 may reach the position of the feeding roller 114 before the document D1, and come into contact with the feeding roller 114. In this case, both of the document coming into contact with the feeding roller 114 and the documents stacked at the lower side of the document may pass through between the feeding roller 114 and the retard roller 115 at a time to result in multi-feed. Therefore, when documents are disposed at the downstream side with respect to the butted part 101*b*, multi-feed can be prevented in advance by notifying the message for prompting re-stacking the documents.

On the other hand, when a document is not present at the position of the contact sensor 113, the control module 161 rotates the shoot roller 110, the pick roller 111, and the feeding roller 114 by driving the first driving device 141*a*. It should be noted that the control module 161 rotates the pick roller 111 with a first speed, and rotates the shoot roller 110 and the feeding roller 114 with a speed at which a document can be conveyed with the same speed as the pick roller 111. The control module 161 rotates the retard roller 115, the first conveying roller 118, and the second conveying roller 123 by driving the second driving device 141*b*. Further, the control module 161 moves the pick arm 112 toward the facing position by driving the third driving device 141*c*, and pressurizes the pick arm 112 onto the documents stacked on the document tray 103 with the first pressurizing force (step S104).

The first speed and the first pressurizing force were defined through an experiment in advance, and are set to a speed and a force with which the pick roller 111 can reliably convey the documents to the separator (the feeding roller 114 and the retard roller 115). In particular, the first speed is set to as fast (high) speed as possible while it stays within a speed that allows the documents to be reliably conveyed to the separator so that the conveying processing of the documents can be executed at a higher speed.

Figure 6B:
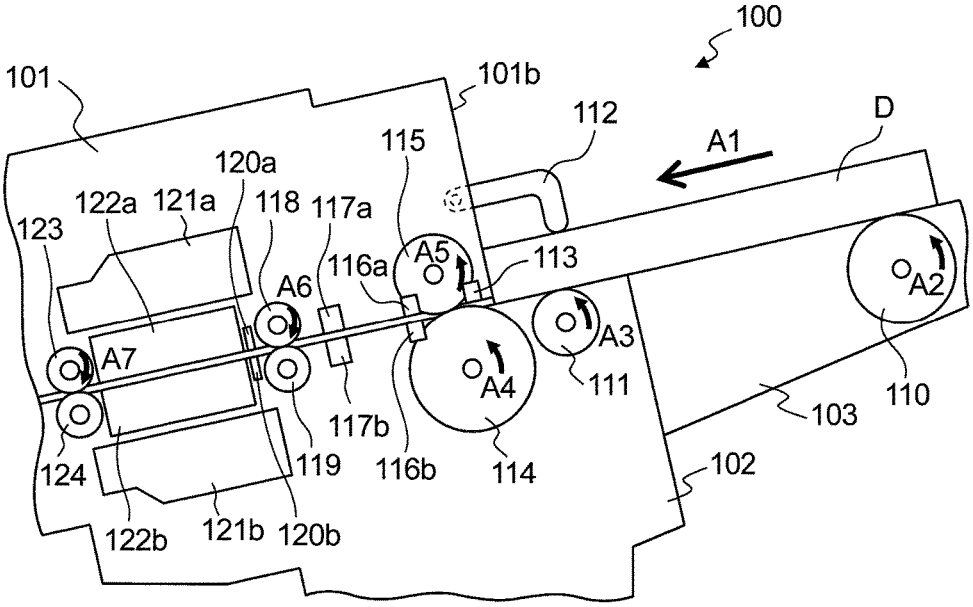
FIG. 6B is a figure illustrating a state in which a pick arm 112 is pressurizing a document.

FIG. 6B is a figure illustrating a state in which the pick arm 112 is pressurizing the documents stacked on the document tray 103.

As illustrated in FIG. 6B, the pick arm 112 moves from the non-facing position as illustrated in FIG. 6A to the facing position, and pressurizes the document D upon coming into contact with the document D stacked on the document tray 103. Accordingly, the frictional force between the pick roller 111 and the document D increases, and when the pick roller 111 rotates, the document D is conveyed in a preferable manner.

Subsequently, the control module 161 determines whether a document is conveyed to the position of the contact sensor 113, i.e., between the butted part 101*b* and the separator based on the first document detection signal received from the contact sensor 113 (step S105).

When the document is not conveyed to between the butted part 101*b* and the separator, the control module 161 determines whether a first predetermined time (for example, one second) has passed since the pick roller 111 starts to rotate (step S106).

In a case where the first predetermined time has not elapsed, the control module 161 returns back to the processing in step S105, and determines again as to whether the document has been conveyed to the position of the contact sensor 113 based on the first document detection signal received from the contact sensor 113.

On the other hand, in a case where the first predetermined time has elapsed, the control module 161 determines that any document is not stacked (does not remain) on the document tray 103, and terminates the series of steps.

When the documents are conveyed to between the butted part 101*b* and the separator in step S105, the control module 161 controls the first driving device 141*a* to rotate the pick roller 111 with a second speed slower (lower) than the first speed. The control module 161 reduces the rotation speeds of the shoot roller 110 and the feeding roller 114 so that the shoot roller 110 and the feeding roller 114 can convey the documents with the same speed as the pick roller 111. Further, the control module 161 drives the third driving device 141*c* to reduce the force with which the pick arm 112 pressurizes the documents (step S107).

For example, without moving the pick arm 112 from the position where it is in contact with the documents, the control module 161 causes the pick arm 112 to pressurize the documents stacked on the document tray 103 with a second pressurizing force lower than the first pressurizing force. As illustrated in FIG. 6A, the control module 161 may move the pick arm 112 to the non-facing position again, so that the pick arm 112 is moved away from the documents, and the pressurizing force with which the pick arm 112 pressurizes the documents is reduced to zero.

The second speed and the second pressurizing force were defined through an experiment in advance, and are set to a speed and a force with which multi-feed is less likely to occur when multiple documents are conveyed.

As described above, the control module 161 causes the pick arm 112 to pressurize the documents stacked on the document tray 103 until the contact sensor 113 detects a document, and rotates the pick roller 111 with the first speed. Therefore, the control module 161 can convey the document at a high speed while maintaining the conveying force of the documents with the pick roller 111 by increasing the frictional force between the pick roller 111 and the documents until the documents reaches the separator.

On the other hand, when the contact sensor 113 detects a document, the control module 161 reduces the force with which the pick arm 112 pressurizes the documents, and rotates the pick roller 111 with the second speed slower than the first speed. Accordingly, after a document reaches a position before the separator, the control module 161 reduces the frictional force between the documents and reduces the conveying speed of the documents. Therefore, the control module 161 does not allow documents stacked at a higher position to attach to and follow the document stacked at a lower position and pass the separator, so that multi-feed can be prevented.

Subsequently, the control module 161 determines whether a document is present at the position of the first optical sensor 116, i.e., at the downstream side with respect to the separator based on the second document detection signal received from the first optical sensor 116 (step S108).

In a case where any document is not conveyed to the downstream side with respect to the separator, the control module 161 determines whether a second predetermined time (for example, one second) has elapsed since the contact sensor 113 detected a document (step S109).

In a case where the second predetermined time has not elapsed, the control module 161 returns back to the processing in step S108 to determine again as to whether a document is conveyed to the position of the first optical sensor 116 based on the second document detection signal received from the first optical sensor 116.

On the other hand, in a case where the second predetermined time has elapsed, the jam determination module 163 determines that a document jam has occurred (step S110).

In a case where a document jam has occurred, the jam determination module 163 stops conveying the document, and notifies the message indicating that the document jam has occurred (step S111), and terminates the series of steps. The jam determination module 163 notifies the user by causing the display device 107 to display the message indicating that the document jam has occurred. The jam determination module 163 may transmit the message indicating that the document jam has occurred to an information processing apparatus, not shown, via the interface 142.

As described above, the jam determination module 163 determines whether a document jam has occurred based on a time from when the contact sensor 113 detects a document to when the first optical sensor 116 detects the document. Since the contact sensor 113 is disposed at the downstream side with respect to the butted part 101*b*, the distance from the contact sensor 113 to the first optical sensor 116 is shorter than the distance from the butted part 101*b* to the first optical sensor 116. Therefore, when a document is correctly conveyed, a time from when the contact sensor 113 detects a document to when the first optical sensor 116 detects the document is shorter than a time from when the pick roller 111 starts rotation to when the first optical sensor 116 detects the document. Therefore, the document conveying apparatus 100 sets the start time of the jam determination to a time when the contact sensor 113 detects the document, so that the jam determination time (second predetermined time) can be set to a shorter value than a case where the start time of the jam determination is set to a time when the pick roller 111 starts rotation. Therefore, in a case where a document jam has occurred, the jam determination module 163 can stop conveying the document at an earlier point in time, and damage of a document can be reduced.

On the other hand, when a document is conveyed to the downstream side of the separator in step S108, the image generation module 164 causes the image capturing device 121 to read the conveyed document, and obtains a read image via the A/D convertor 140 (step S112). The image generation module 164 detects a point in time when the document is conveyed to a position before the illumination device 122 (i.e., a position before the imaging position of the image capturing device 121) based on the third document detection signal received from the second optical sensor 120, and causes the image capturing device 121 to read the document in accordance with the point in time of detection.

Subsequently, the image generating module 164 transmits the read image via the interface 142 to an information processing apparatus, not shown (step S113). In a case where it is not connected to the information processing apparatus, the image generating module 164 stores the read image to the storage 150.

Subsequently, the control module 161 determines whether a document is still present at the position of the contact sensor 113, i.e., between the butted part 101*b* and the separator, based on the first document detection signal received from the contact sensor 113 (step S114).

When a document is still present between the butted part 101*b* and the separator, the control module 161 returns back to the processing in step S108, and repeats the processing in steps S108 to S114. More specifically, when the contact sensor 113 continues to detect a document, the control module 161 conveys a subsequent document while the force with which the pick arm 112 pressurizes the documents is reduced, and the pick roller 111 is rotated with the second speed. Therefore, the control module 161 does not allow documents stacked at a higher position to attach to and follow the document stacked at a lower position and pass the separator, so that multi-feed can be prevented.

On the other hand, when a document is no longer present between the butted part 101*b* and the separator, the control module 161 returns back to the processing in step S104 to repeat the processing in steps S104 to S114. More specifically, when the contact sensor 113 no longer detects any document after detecting a document, the control module 161 conveys a subsequent document upon causing the pick arm 112 to pressurize the documents stacked on the document tray 103 again and causing the pick roller 111 to rotate with the first speed.

Therefore, even when a subsequent document is not conveyed to the separator by reducing the pressurizing force with the pick arm 112, the control module 161 can increase the frictional force between the pick roller 111 and the document again and convey the subsequent document in a preferable manner. At this occasion, since the rotation speed of the pick roller 111 is increased, a subsequent document can be conveyed to the separator at a high speed.

Thereafter, the control module 161 repeats execution of each processing until the control module 161 determines that any document does not remain on the document tray 103 in step S106.

As described above in details, until a document reaches the separator, the document conveying apparatus 100 increases the frictional force between the pick roller 111 and the documents, so that the document conveying apparatus 100 conveys the documents at a high speed while the conveying force of the documents with the pick roller 111 is maintained. On the other hand, after the document reaches a position before the separator, the document conveying apparatus 100 reduces the frictional force between the documents and reduces the conveying speed of the documents, so that multi-feed of documents is prevented. Therefore, in the document conveying apparatus 100 of the lower side retrieval method, the conveying processing of documents can be executed at a higher speed while multi-feed of documents is prevented.

Figure 9:
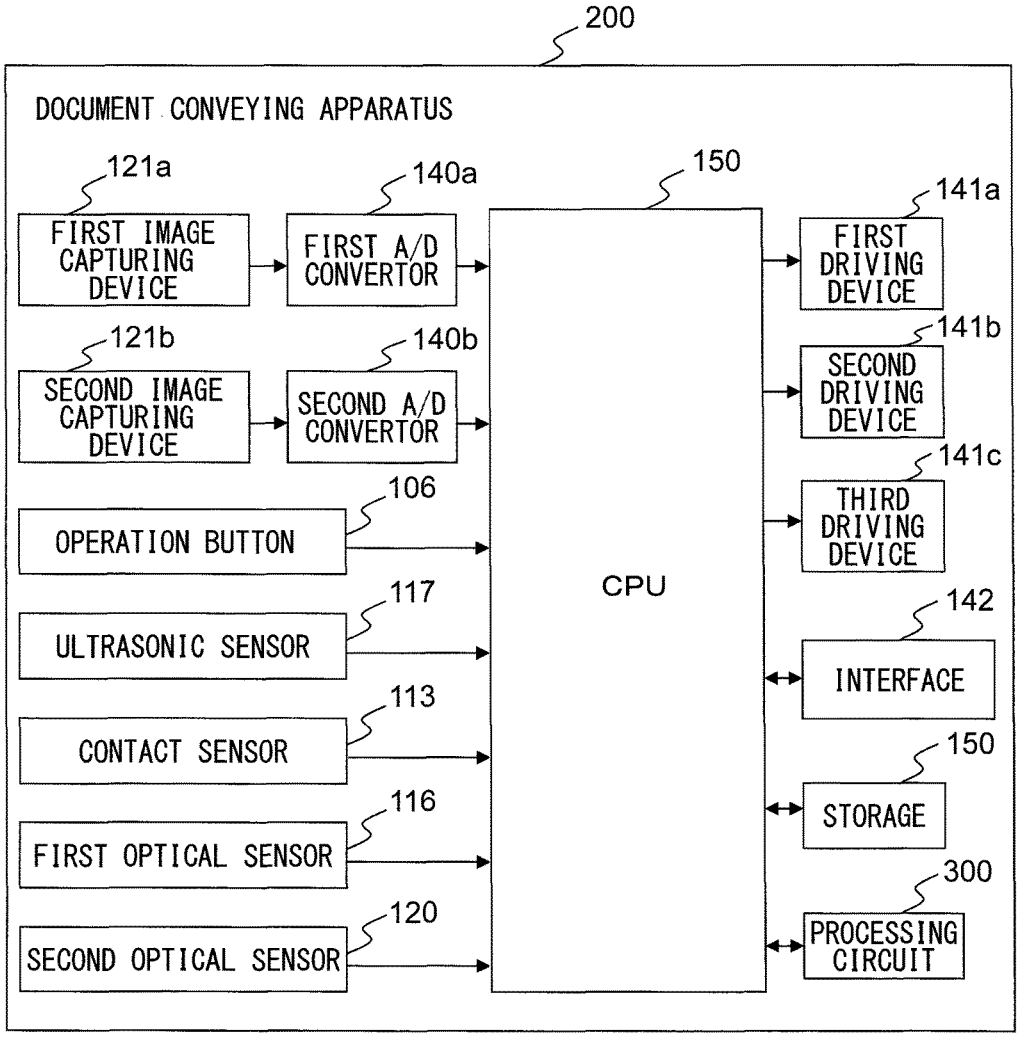
FIG. 9 is a block diagram illustrating a schematic configuration of another document conveying apparatus 200.

FIG. 9 is a block diagram illustrating a schematic configuration of a document conveying apparatus 200 according to another embodiment.

The document conveying apparatus 200 includes not only the units of the document conveying apparatus 100 but also a processing circuit 300. The processing circuit 300 is a DSP, an LSI, an ASIC, an FPGA, or the like, and executes document reading processing instead of the CPU 160.

Figure 10:
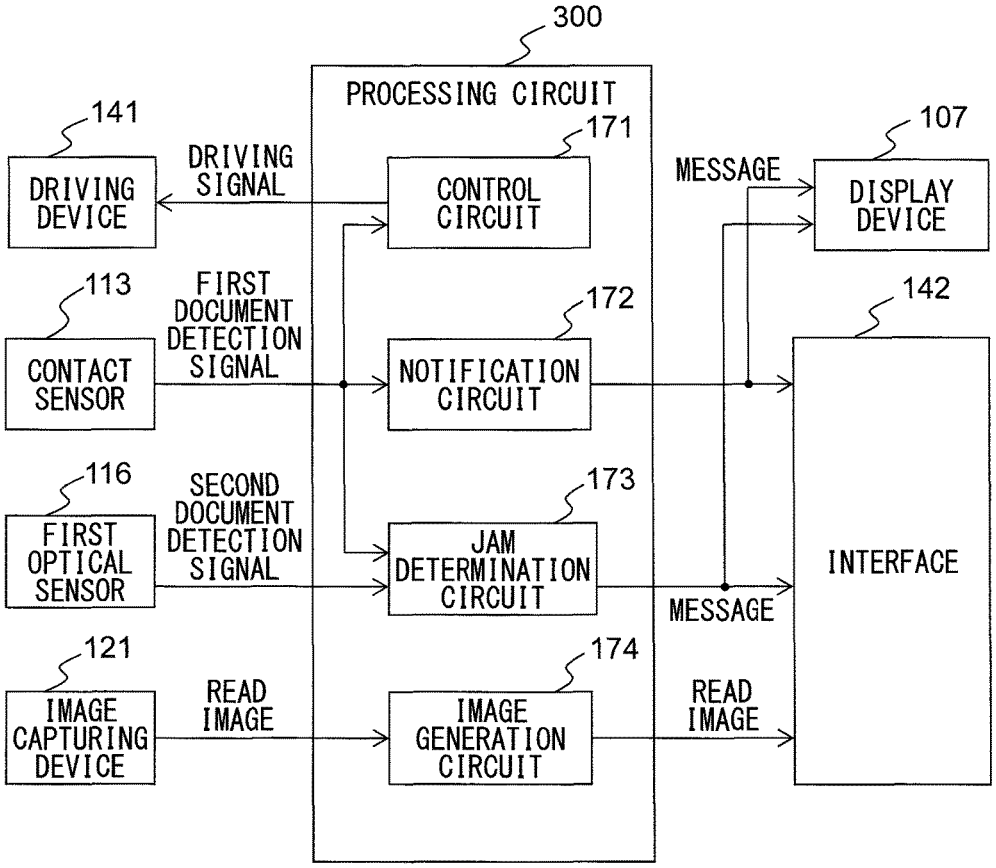
FIG. 10 is a figure illustrating a schematic configuration of a processing circuit 300.

FIG. 10 is a figure illustrating a schematic configuration of the processing circuit 300.

The processing circuit 300 includes a control circuit 171, a notification circuit 172, a jam determination circuit 173, an image generation circuit 174, and the like. Each unit may include an integrated circuit, a microprocessor, a firmware, and the like, each of which is independent from each other.

The control circuit 171 is an example of a control module. The control circuit 171 receives the first document detection signal from the contact sensor 113, and outputs, to the driving device 141, a driving signal for controlling movement of the pick arm 112 and rotation of each roller in accordance with the received first document detection signal.

The notification circuit 172 is an example of a notification module. The notification circuit 172 receives the first document detection signal from the contact sensor 113, and outputs the message for prompting re-stacking the documents to the display device 107 or the interface 142 based on the received first document detection signal.

The jam determination circuit 173 is an example of a jam determination module. The jam determination circuit 173 receives the first document detection signal from the contact sensor 113, and receives the second document detection signal from the first optical sensor 116. The jam determination circuit 173 determines whether a document jam has occurred based on the first document detection signal and the second document detection signal received, and outputs the message indicating that the document jam has occurred to the display device 107 or the interface 142 in a case where a jam has occurred.

The image generation circuit 174 is an example of an image generation module. The image generation circuit 174 receives a read image from the image capturing device 121, and outputs the received read image to the interface.

As described above in details, like the document conveying apparatus 100, the document conveying apparatus 200 can also execute the conveying processing of documents at a higher speed while preventing multi-feed of documents.

According to the document conveying apparatus, the control method, and the computer-readable, non-transitory medium, conveying processing of documents can be executed at a high speed while preventing occurrence of multifeed of documents with the document conveying apparatus of lower side retrieval method.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiment(s) of the present inventions have been described in detail, it should be understood that the various changes, substitutions, and alterations could be made hereto without departing from the spirit and scope of the invention.

What is claimed is:

1. A document conveying apparatus comprising:

a document tray;

a butted part with which leading edges of a plurality of documents stacked on the document tray are butted;

a roller for conveying a document stacked at a lowermost position, which is one of the documents stacked on the document tray;

a pressurizing module, provided at a position facing the roller, for pressurizing, from above, the documents stacked on the document tray;

a separator for separating and conveying the documents;

a first detector, provided between the butted part and the separator in a document conveying direction, for detecting a conveyed document; and a control module for causing the pressurizing module to pressurize the documents stacked on the document tray and causing the roller to rotate with a first speed until the first detector detects a document, wherein in a case where the first detector detects a document, the control module reduces a force with which the pressurizing module pressurizes the documents and causes the roller to rotate with a second speed slower than the first speed.

2. The document conveying apparatus according to claim 1, wherein in a case where the first detector no longer detects any document after detecting a document, the control module causes the pressurizing module to pressurize the documents stacked on the document tray again and causes the roller to rotate with the first speed.

3. The document conveying apparatus according to claim 1, further comprising:

a second detector, provided at a downstream side with respect to the separator in the document conveying direction, for detecting a conveyed document; and a jam determination module for determining whether a document jam has occurred, based on a time from when the first detector detects a document to when the second detector detects a document.

4. The document conveying apparatus according to claim 1, further comprising a notification module for notifying a message for prompting re-stacking the documents when the first detector detects a document while the roller is not rotated.

5. A control method for a document conveying apparatus including a document tray, a butted part with which leading edges of a plurality of documents stacked on the document tray are butted, a roller for conveying a document stacked at a lowermost position, which is one of the documents stacked on the document tray, a pressurizing module, provided at a position facing the roller, for pressurizing, from above, the documents stacked on the document tray, and a separator for separating and conveying the documents, the control method comprising:

causing the pressurizing module to pressurize the documents stacked on the document tray and causing the roller to rotate with a first speed until a first detector, provided between the butted part and the separator in a document conveying direction, for detecting a conveyed document, detects the document; and in a case where the first detector detects a document, reducing a force with which the pressurizing module pressurizes the documents and causing the roller to rotate with a second speed slower than the first speed.

6. A computer-readable, non-transitory medium storing a computer program, wherein the computer program causes a document conveying apparatus including a document tray, a butted part with which leading edges of a plurality of documents stacked on the document tray are butted, a roller for conveying a document stacked at a lowermost position, which is one of the documents stacked on the document tray, a pressurizing module, provided at a position facing the roller, for pressurizing, from above, the documents stacked on the document tray, and a separator for separating and conveying the documents, to execute a process, the process comprising:

causing the pressurizing module to pressurize the documents stacked on the document tray and causing the roller to rotate with a first speed until a first detector provided between the butted part and the separator in a document conveying direction to detect a document conveyed detects the document; and when the first detector detects a document, reducing a force with which the pressurizing module pressurizes the documents and causing the roller to rotate with a second speed slower than the first speed.

* * * * *